US006461200B1

(12) United States Patent
Shi et al.

(10) Patent No.: US 6,461,200 B1
(45) Date of Patent: Oct. 8, 2002

(54) ELECTRICAL CONNECTOR ASSEMBLY

(75) Inventors: GuangXing Shi; Suiya Wang, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/014,965

(22) Filed: Dec. 11, 2001

(51) Int. Cl.[7] ..... H01R 24/06

(52) U.S. Cl. ..... 439/676; 439/620; 439/607; 439/701

(58) Field of Search ..... 439/676, 701, 439/607–610, 489, 490, 620

(56) References Cited

U.S. PATENT DOCUMENTS 5,989,069 A * 11/1999 Tan ..... 439/620
6,010,367 A * 1/2000 Wu ..... 439/620
6,336,830 B1 * 1/2002 Lee ..... 439/676
6,375,514 B1 * 4/2002 Chih et al. ..... 439/676

* cited by examiner

*Primary Examiner*—Hien Vu
(74) *Attorney, Agent, or Firm*—Wei Te Chung

(57) ABSTRACT

A connector assembly (1) comprises an insulative housing (10) defining an opening (18) through a top face (106) thereof, a plurality of first and second terminals (20, 30) retained in the housing, and a pressing device (50) with a plurality of wires (61) secured thereto. Each first terminal includes a first downwardly extending tail portion (224) for connecting with a printed circuit board (80). Each second terminal includes a second upwardly extending tail portion (324) projecting into the opening. The pressing device is assembled to the opening to press the wires against the second tail portions of the second terminals.

4 Claims, 8 Drawing Sheets

ELECTRICAL CONNECTOR ASSEMBLY

BACKGROUND OF THE INVENTION

1. Field of the Invention

The present invention relates to an electrical connector assembly, and particularly to a receptacle connector assembly of modular jacks which is soldered to a printed circuit board and connected with a wire harness cable.

2. Description of the Related Art

A receptacle connector assembly of modular jacks is commonly used in computer systems and communication networks. The receptacle connector assembly includes a RJ45 modular jack and a RJ11 modular jack arranged in a stacked or side-by-side manner. Conventionally, there exists two ways of mounting the connector assembly to a computer. Generally, the RJ45 and RJ11 modular jacks are both soldered to a printed circuit board of the computer, whereby the connector assembly is fixedly mounted in the computer. However, soldering terminals of the connector assembly to the printed circuit board is time-consuming and thus increases the cost of production. In another way, the RJ45 and RJ11 modular jacks are positioned at a panel of the computer and respectively connected with a RJ45 wire harness cable and a RJ11 wire harness cable to engage with Mini PCI (Peripheral Component Interconnect) cards. However, due to the frequently plugging and pulling force produced by complementary mating connectors, the connector assembly located at the panel of the computer is easy to loose and thus will cause an unreliable engagement between the connector assembly and the complementary connectors as well as affect the quality of signal transmission therebetween.

Hence, an improved connector assembly is desired to overcome the disadvantages of the related art.

SUMMARY OF THE INVENTION

An object of the present invention is to provide a receptacle connector assembly of modular jacks which is mounted on a printed circuit board of a computer and connected with a wire harness cable, whereby the connector assembly is not only fixedly mounted in the computer but also connected with a Mini PCI card.

To achieve the above-mentioned object, a connector assembly in accordance with the present invention comprises an insulative housing, a plurality of first and second terminals retained in the housing, and a pressing device with a plurality of wires secured thereto. The housing defines a first and a second receiving cavities in a front face thereof and an opening in a rear face thereof. Each first terminal includes a first contacting portion received in the first receiving cavity and a first downwardly extending tail portion for connecting with a printed circuit board. Each second terminal includes a second contacting portion received in the second receiving cavity and a second upwardly extending tail portion projecting into the opening. Each wire has a conductor core and an outer insulator. The conductor core has a portion exposed out of the outer insulator for electrically connecting with a corresponding second terminal. The pressing device defines a plurality of recesses with the wires retained therein. The pressing device is assembled to the opening of the housing and the exposed portion of the conductor core abuts against the second tail portion of a corresponding second terminal to establish an electrical connection therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
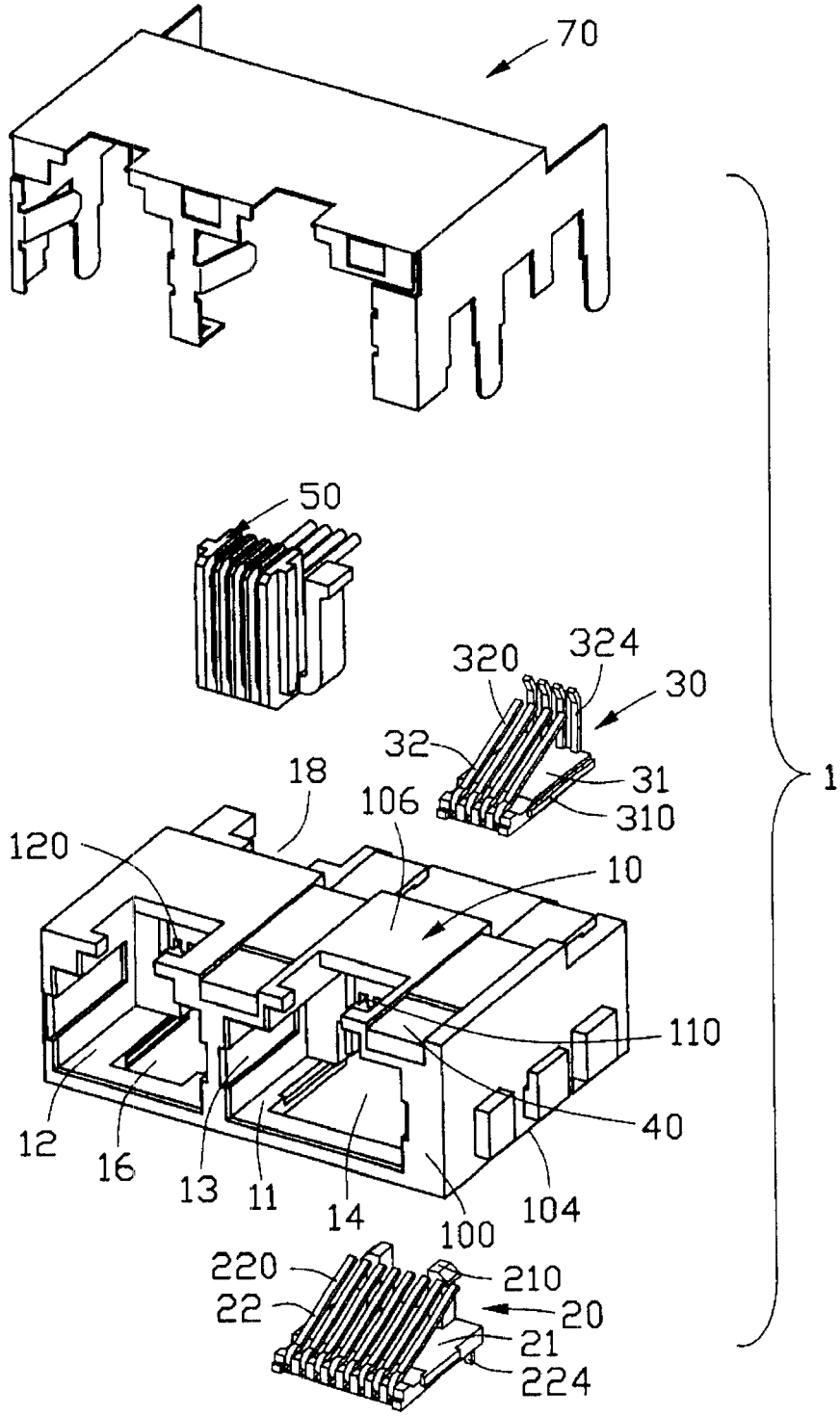
FIG. 1 is an exploded, perspective view of a connector assembly consisting of a RJ45 and a RJ11 connectors in accordance with the present invention.

Referring to FIG. 1, a receptacle connector assembly 1 in accordance with the present invention consists of a RJ45 and a RJ11 receptacle connectors arranged in a side-by-side manner. The receptacle connector assembly 1 comprises a unitarily molded insulative housing 10, a first terminal insert 20 and a second terminal insert 30 both retained in the housing 10, a pair of Light-Emitting Diodes (LEDs) 40 secured to the housing 10, a pressing device 50 (FIG. 4) for connecting a cable 60 to the RJ11 connector, and a shell 70 enclosing the insulative housing 10.

The insulative housing 10 is generally of a rectangular configuration having a front face 100, a rear face 102 (FIG. 2) opposite to the front face 100, a bottom face 104, and a top face 106 opposite to the bottom face 104. The housing 10 defines a first large-dimensioned receiving cavity 11 and a second small-dimensioned receiving cavity 12 in the front face 100 thereof. The second receiving cavity 12 is separated from the first receiving cavity 11 by a partition 13. The housing 10 defines a first and a second openings 14, 16 in the bottom face 104 and respectively communicating with the first and the second receiving cavities 11, 12. The housing 10 further defines a third opening 18 through the rear face 102 and the bottom face 104. In addition, the housing 10 defines a plurality of first and second passageways 110, 120 respectively in communication with the first receiving cavity 11 and the second receiving cavity 12. The housing 10 has a plurality of positioning pins 19 (FIG. 3) extending downwardly from the bottom face 104.

Figure 2:
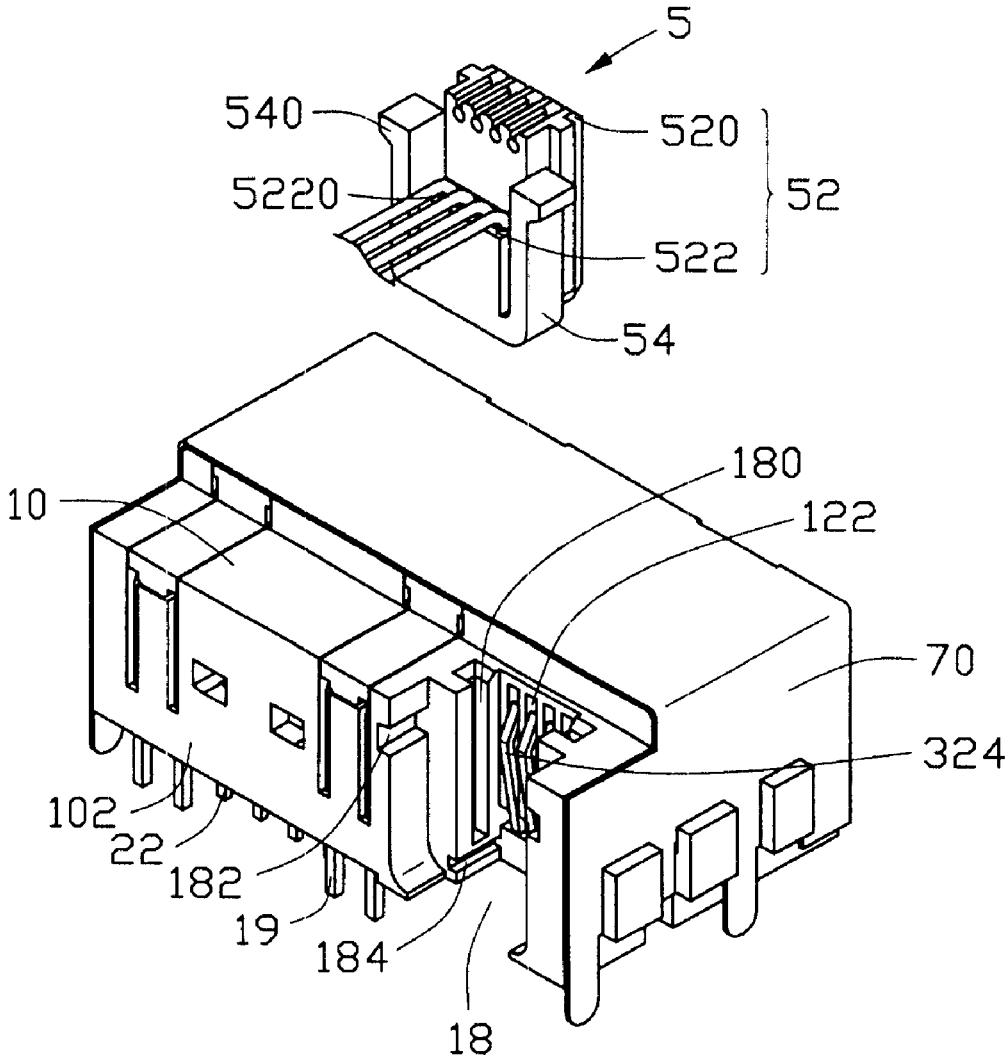
FIG. 2 is a partially assembled, perspective view of the connector assembly.

Referring to FIG. 2, the housing 10 defines a plurality of slots 122 corresponding to the second passageways 120 and in communication with the third opening 18. The housing 10 further defines a pair of channels 180 and a pair of horizontally aligned concavities 182 on opposite sides of the third opening 18. The housing 10 also defines a pair of guiding recesses 184 on opposite sides of the third opening 18 and adjacent to the bottom face 104.

Figure 3:
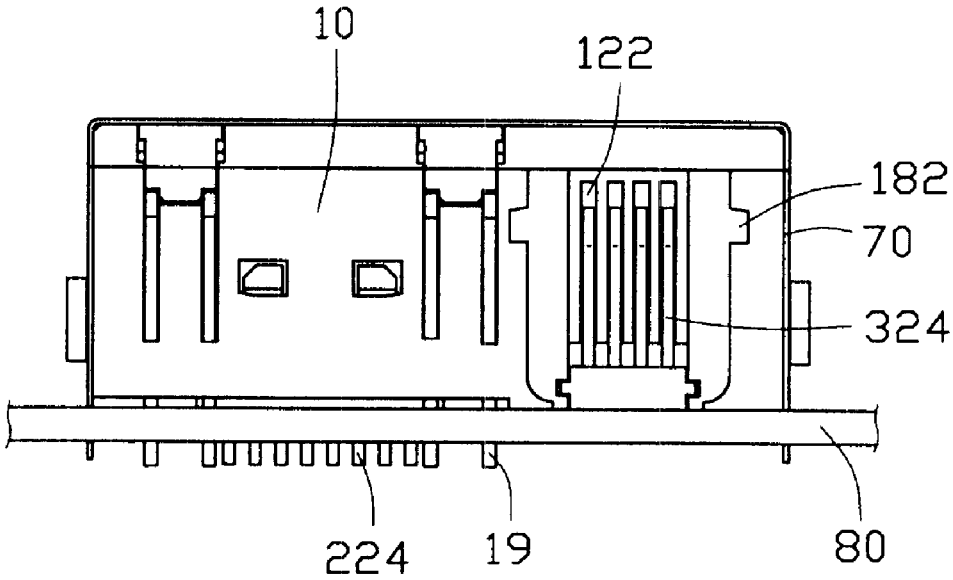
FIG. 3 is a rear, plan view of the connector assembly of FIG. 2 showing the RJ45 connector being mounted on a printed circuit board.

The first and second terminal inserts 20, 30 are assembled to the housing 10 respectively via the first and second openings 14, 16. The first terminal insert 20 comprises a first insulative body 21 and a plurality of first terminals 22 retained to the first body 21. The first body 21 has a pair of fixed portions 210 upwardly extending from a top face thereof for being received and retained in corresponding cavities (not shown) of the housing 10. Each first terminal 22 includes a first contacting portion 220 extending above the top face of the body 21, a first retention portion (not shown) extending from the contacting portion 220 and embedded in the first body 21, and a first tail portion 224 extending from the first retention portion and projecting beyond a bottom face of the first body 21 for being soldered to a printed circuit board 80 (FIG. 3).

The second terminal insert 30 comprises a second insulative body 31 and a plurality of second terminals 32 retained to the second body 31. The second body 31 has a pair of guide portions 310 on opposite sides thereof. Each second terminal 32 includes a second contacting portion 320 extending above a top face of the second body 31, a second retention portion 322 (shown in FIG. 8) extending from the second contacting portion 320 and embedded in the second body 31, and a second tail portion 324 upwardly extending from the second retention portion 322 and being formed at an obtuse angle with respect to the second retention portion 322.

Figure 4:
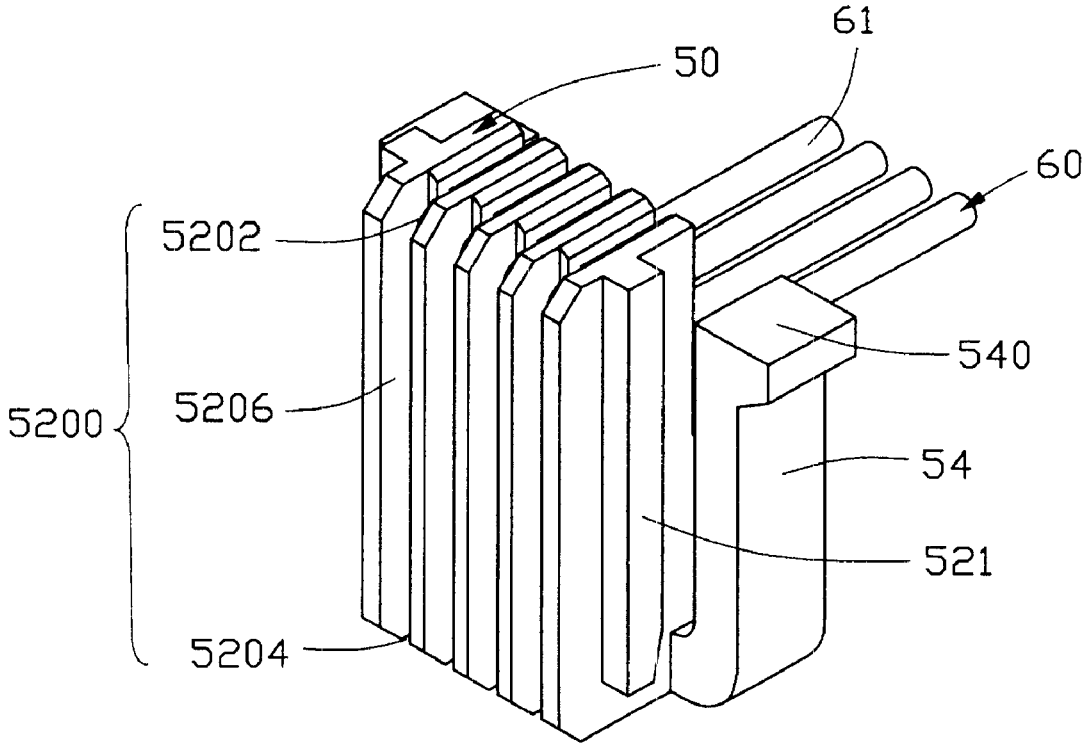
FIG. 4 is a perspective view of a pressing device which is used for connecting an RJ11 wire harness cable to the RJ11 connector of the connector assembly.
Figure 5:
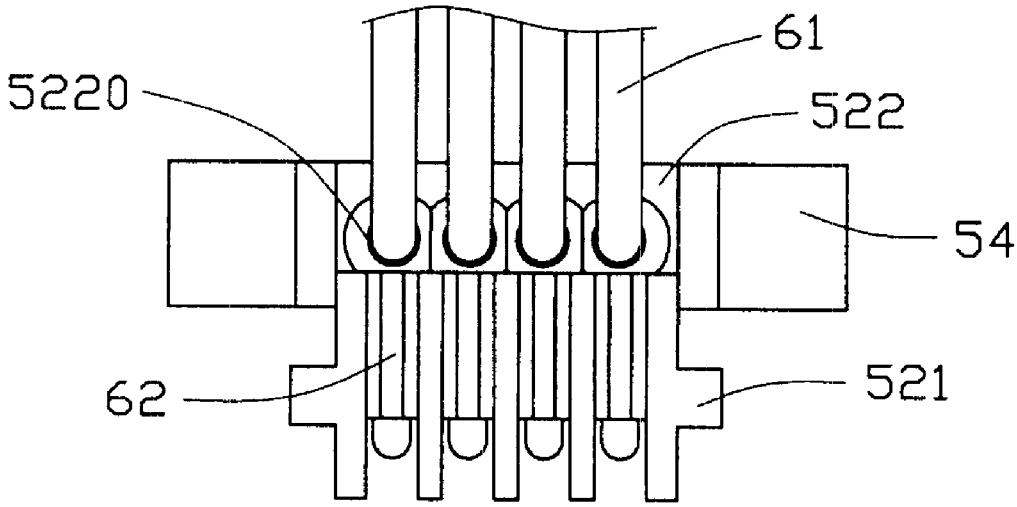
FIG. 5 is a top, plan view of the pressing device.
Figure 6:
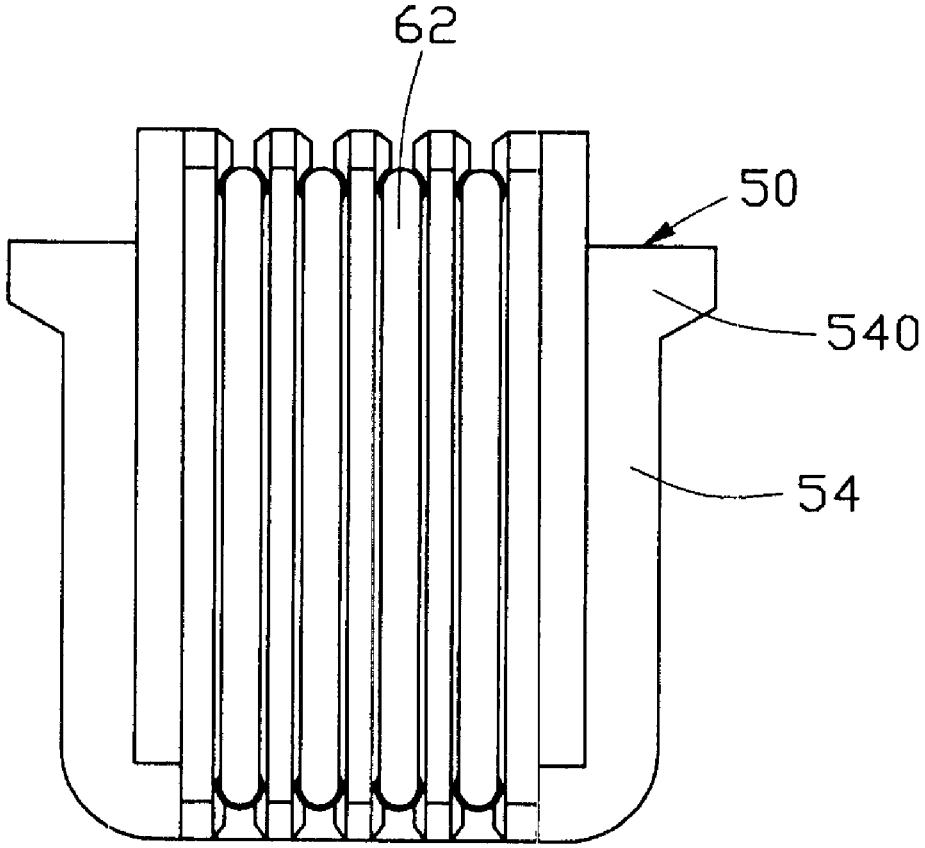
FIG. 6 is a front, plan view of the pressing device.

Referring to FIGS. 4, 5 and 6, the pressing device 50 with the cable 60 secured thereto is assembled to the third opening 18 of the housing 10 from the top face 106 in a vertical direction. The pressing device 50 comprises a base portion 52 and a pair of resilient latch arms 54 located at opposite ends of the base portion 52. The base portion 52 is L-shaped including a front portion 520 and a rear portion 522. The front portion 520 has a pair of guiding posts 521 formed at opposite ends thereof. The front portion 520 defines a plurality of recesses 5200 therein. Each recess 5200 comprises a pair of vertically aligned recesses 5202, 5204 respectively in a top and a bottom faces of the front portion 520, and a vertical recess 5206 in a front face of the front portion 520 communicating with the vertically aligned recesses 5202, 5204. The rear portion 522 defines a plurality of holes 5220 extending through top and bottom faces thereof. Each latch arm 54 has an outwardly extending projection 540 at an upper portion thereof.

The cable 60 comprises a plurality of wires 61 each having a conductor core 62 which is surrounded by an outer insulator 63. The conductor core 62 has a portion exposed out of the outer insulator 63 for electrically connecting with the second tail portion 324 of a corresponding second terminal 32. The wires 61 are first extending through the holes 5220 of the rear portion 522 and then received and retained in the recesses 5200 of the front portion 520 wherein exposed portions of the wires 61 are retained in the vertical recesses 5206.

Figure 7:
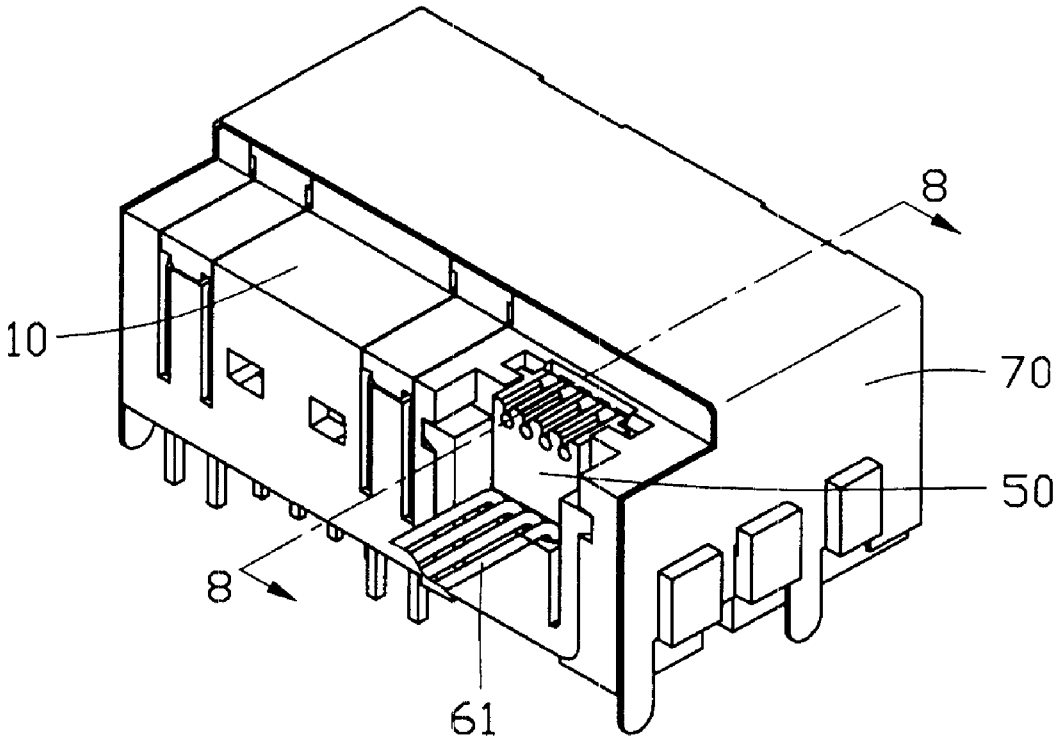
FIG. 7 is a rear, perspective view of the connector assembly showing the pressing device is completely connected with the RJ11 connector of the connector assembly.
Figure 8:
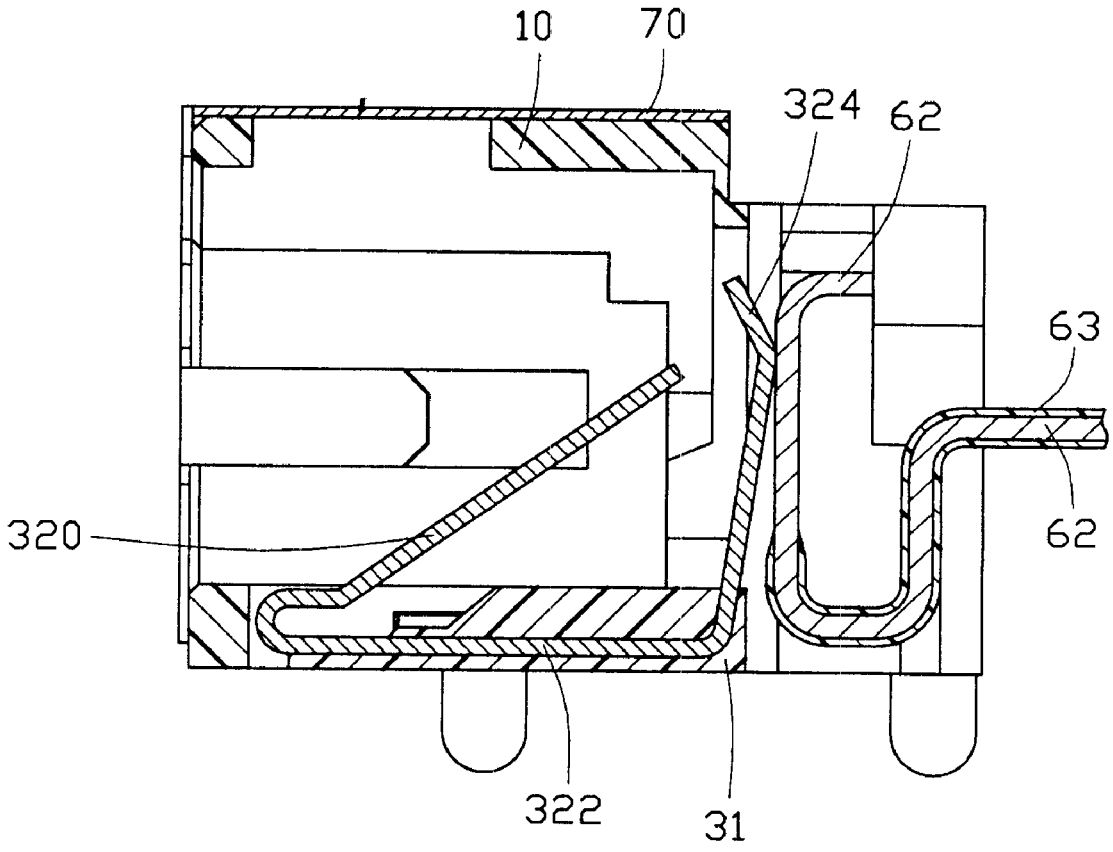
FIG. 8 is a cross-sectional view of the connector assembly taken along section line 8—8 in FIG. 7.

Also referring to FIGS. 7 and 8, in assembly, the first terminal insert 20 is assembled to the first opening 14 from the bottom face 104. The first contacting portions 220 of the first terminals 22 extend into the first receiving cavity 11 for engaging with corresponding terminals of a complementary RJ45 plug connector (not shown). At the same time, a free end of each first contacting portion 220 is received and retained in a corresponding first passageway 110. The first tail portions 224 project beyond the bottom face 104 of the housing 10 for being soldered to the printed circuit board 80. The second terminal insert 30 is assembled to the second opening 16 from the rear face 102. The guide portions 310 are received in the guiding recesses 184 of the housing 10 to facilitate sliding the second terminal insert 30 into the second opening 16 until the second contacting portions 320 are received in the second receiving cavity 12 for engaging with corresponding terminals of a complementary RJ11 plug connector (not shown). At the same time, a free end of each second contacting portion 320 is received and retained in a corresponding second passageway 120. Also, a free end of each second tail portion 324 is received and retained in a corresponding slot 122. The shell 70 is attached to the housing 10 from the top face 106 in a vertical direction for ESD (Electrostatic Discharge) protection.

Then, the connector assembly 1 as shown in FIG. 2 is mounted onto the printed circuit board 80. The positioning pins 19 of the housing 10 are respectively received within corresponding positioning holes (not shown) defined in the printed circuit board 80. The first tail portions 224 are soldered to the printed circuit board 80 for establishing an electrical connection between the complementary RJ45 plug connector and the printed circuit board 80.

Finally, the pressing device 50 with the wires 61 retained therein is assembled to the third opening 18 from the top face 106 in a vertical direction. The guiding posts 521 are received in the channels 180 for guiding the pressing device 50 into the third opening 18. The resilient latch arms 54 first spring inwardly in a compressed condition and then spring outwardly to make the projections 540 received and retained in the concavities 182, thereby stably mounting the pressing device 50 on the housing 10. The second tail portions 324 of the second terminals 32 are respectively received in the corresponding vertical channels 5206 of the pressing device 50 to press against the exposed portions of the conductor cores 62, respectively. Thus, an electrical connection is established between the wires 60 and the second terminals 32.

During the assembly, the RJ45 modular jack of the connector assembly 1 is first soldered to the printed circuit board 80. Then, the pressing device 50 with the wires 61 retained therein is assembled to the housing 10 for establishing an electrical engagement between the RJ11 modular jack and the wires 61. In this way, the RJ45 modular jack of the connector assembly 1 can be connected with the printed circuit board 80 via a spot welding technology rather than a wave soldering technology. Therefore, the efficiency of manufacture is improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for being mounted on a printed circuit board, comprising:

an insulative housing defining first and second openings in a bottom face of the housing, a third opening through a top face of the housing, and a first and a second receiving cavities trough a front ace thereof for receiving an UJ45 modular jack and an RJ11 modular jack, respectively;

a plurality of first and second terminals retained in the housing, each first terminal including a first contacting portion received in the first receiving cavity and a first downwardly extending tail portion for connecting with a printed circuit board, each second terminal including a second contacting portion received in the second receiving cavity and a second tail portion received in the opening;

a plurality of wires each having a conductor core and an outer insulator, a portion of the conductor core being exposed for electrically connecting with a corresponding second terminal; and a pressing device assembled to the opening of the housing to press the exposed portion of the conductor core against the second tail portion of a corresponding second terminal; wherein the pressing device defines a plurality of recesses retaining the exposed portions of the conductor cores; wherein the housing defines a pair of channels and a pair of concavities on opposite sides of the opening for engaging with the pressing device; wherein the pressing device comprises a base portion and a pair of resilient latch arms located at opposite ends of the base portion for being received and retained in the concavities; wherein the base portion has a pair of guiding posts formed on opposite sides thereof for being received in the channels; wherein a shell is attached to the insulative housing for electrostatic discharge protection.

2. The cable connector assembly as claimed in claim 1, wherein each recess comprises a pair of vertically aligned recesses respectively in a top and a bottom faces of the base portion and a vertical recess communicating with the vertically aligned recesses.

3. The cable connector assembly as claimed in claim 2, wherein the base portion defines a plurality of holes connecting with the recesses for accommodating the wires.

4. The cable connector assembly as claimed in claim 1, wherein the housing defines a plurality of slots each in communication with the opening for receiving the second tail portions of the second terminals.

* * * * *